US008332970B2

(12) United States Patent
Li et al.

(10) Patent No.: US 8,332,970 B2
(45) Date of Patent: Dec. 18, 2012

(54) FLUSHING MECHANISM

(75) Inventors: Feiyu Li, Xiamen (CN); Caiyou Li, Xiamen (CN)

(73) Assignee: Feiyu Li, Xiamen, Fujian (CN)

( * ) Notice: Subject to any disclaimer, the term of this patent is extended or adjusted under 35 U.S.C. 154(b) by 302 days.

(21) Appl. No.: 12/786,892

(22) Filed: May 25, 2010

(65) Prior Publication Data

US 2010/0230625 A1 Sep. 16, 2010

(51) Int. Cl.
*E03D 1/36* (2006.01)

(52) U.S. Cl. ..... 4/367; 4/354; 4/380

(58) Field of Classification Search ..... 251/63.4, 251/28; 137/630, 630.14; 4/354, 366, 367, 4/378, 380, 405, 414
See application file for complete search history.

(56) References Cited

U.S. PATENT DOCUMENTS

| | | | | |
|---|---|---|---|---|
| 4,984,311 | A | 1/1991 | Basile et al. | |
| 5,027,444 | A * | 7/1991 | Tsals | 4/226.1 |
| 7,975,324 | B2 * | 7/2011 | Ge et al. | 4/326 |
| 2004/0064880 | A1 * | 4/2004 | Beh | 4/354 |
| 2004/0194200 | A1 * | 10/2004 | Li | 4/354 |
| 2005/0150038 | A1 * | 7/2005 | Li | 4/354 |

FOREIGN PATENT DOCUMENTS

| | | | |
|---|---|---|---|
| CN | 2677468 | Y | 2/2005 |
| CN | 2747290 | Y | 12/2005 |
| JP | 9-21157 | A | 1/1997 |
| WO | WO 02/46540 | A1 | 6/2002 |

OTHER PUBLICATIONS

PCT International Search Report and Written Opinion dated Oct. 12, 2010.

* cited by examiner

*Primary Examiner* — Eric Keasel
*Assistant Examiner* — Reinaldo Sanchez-Medina
(74) *Attorney, Agent, or Firm* — Hasse & Nesbitt LLC; Daniel F. Nesbitt

(57) ABSTRACT

A flushing mechanism (100) includes a housing (1), an upper cover (6) on the housing (1), a sleeve (3), a first piston (4), a first piston sealed module (4-3), a first piston loading spring (5), a second piston (8) and a second piston loading spring (9). Wherein a pressure-relief and/or ejection-proof part is provided in the housing (1), the second piston sealed module (8-3, 8-4) are respectively provided surround the periphery of the bottom end and the central hole of the second piston (8). The bottom end of the second piston (8), the second piston sealed module (8-3, 8-4) and the lower end of the housing (1) define an exterior lower cavity (8-5) and an interior lower cavity (8-6) used for cooperating with the second piston loading spring (9) in course of drainage, sequentially the second piston (8) is moved upward and the outlet is opened. A toilet bowl employing the flushing mechanism can reduce the flushing water consumption.

14 Claims, 8 Drawing Sheets

FLUSHING MECHANISM

CROSS REFERENCE TO RELATED APPLICATIONS

This application claims the benefit of International Application PCT/CN2009/070363, with an international filing date of Feb. 5, 2009, which claimed the benefit of Chinese Patent Application No. CN 200810091185.6, filed Apr. 9, 2008.

TECHNICAL FIELD

This invention generally relates to a flushing mechanism for flushing ordure and/or sewage, in particular, to a flushing mechanism adapted for flushing bathroom apparatus such as a toilet bowl. The flushing mechanism according to the invention can lower the needed water pressure by using the elasticity of a loading spring and water pressure, such that the water consumption for each flushing cycle can be reduced, and its structure is simple with a lower noise, meanwhile, the installation of such flushing mechanism is convenient for being adapted to be mounted inside or outside of the toilet bowl.

BACKGROUND ART

Since the water resource is increasing scarce in the world, it is one of the important problems concerned by the scientists and engineers engaged in the research on the environmental sanitation all over the world to utilize the water resource efficiently and to improve various water consumption apparatuses.

A toilet flushing apparatus is widely used in families, hotels or other various human activities places. Since it is used a lot, the problem that whether the flushing mechanism can save water is particularly important. The Chinese Ministry of Construction has demanded that the water consumption for each flushing cycle shall be lower than 6 liters, which would be a challenge undoubtedly for the researchers dedicated in the art of bathroom apparatus.

It is well-known that the greater the stored energy of the flushing water, the better the flushing effect would be, and therefore that a lesser amount of water is needed thr achieving the same flushing effect. Therefore, it is an efficient measure to improve the stored energy of the flushing water for saving the water consumption.

Compared with the technical solution of improving the flushing effect of the toilet flushing apparatus by the method of utilizing compressed air to store the energy, the technical solution of utilizing a spring to load the stored energy has many advantages. Taking the flushing mechanism of the toilet as an example, since the stored energy element is a spring not air, when the spring is compressed by the pre-compression force, the efficiency of spring energy storage is much greater than that of air compressing energy storage, and thus the problems that exist in the process for storing energy by compressing air can be avoided by spring energy storage, such as: (1) at the beginning of drainage, high pressure, fast flow, great impact to the toilet bowl and big noise shall appear, but at the end of drainage, when a stable water supply is needed, the pressure of the water will rapidly declined with less impulsive force, and the pressure of water supply must be further increased if the user wants to achieve the expected impact; (2) if the housing is caused to be fatigued and aged by repeated compression-recovery, or is broken or damaged by accidental crush, the air and debris thereof shall be distributed around when blasting or releasing the high pressure air, and their directions can not be controlled, such that it possesses the defects like security risks. Therefore, people tend to develop and exploit the flushing apparatus with spring energy storage.

U.S. Pat. No. 4,984,311 (hereafter referred to the reference 1, the entire disclosure of which is incorporated herein by reference) discloses a flushing mechanism with low water consumption, which comprises a plastic housing, a cistern and hydraulic actuation system, wherein the cistern is provided with a piston, the piston is biased in the cistern by a mechanical compression piston spring. When the flushing valve is closed and the water is filled in the cistern to be stand-by, the piston is pressured by the water (equivalent to the water pressure in conduit) to overcome the downward elasticity of the spring to move upwards; when the piston is stopped moving, the upward water pressure applied on the piston is equal to the pressure of the loaded spring. A flushing valve is fixed to the bottom of the containment vessel that has a central opening. The flushing valve stretches along the central portion of the containment vessel, wherein a first end portion of the valve rod is connected to the flushing valve, and a second end of the valve rod is connected to the flushing valve plate. A flushing valve spring is fixed on the flushing valve plate that is biased to the stand-by position by the effect of the flushing valve spring. When flushing, the flushing button is actuated, and then the water in the conduit flows into the gap of the actuating room by the head, so as to pressurize the actuating room until the supply water pressure which functions to the flushing valve to generate the force applied to the spring of the flushing valve and pushes the flushing valve rod upwards to cause the flushing valve leaving from the flushing valve body to open the discharge outlet. A scroll diaphragm is further disposed in the flushing mechanism, which is for preventing the water in the containment vessel from flowing out of the first piston and preventing the water from contacting with the first piston spring.

As recited above, the flushing mechanism of this reference adapts a plastic housing, and the aging of itself and the accidental crushing and dropping during the use shall lead to the housing breaking to release the energy of the spring, but such instantaneous energy releasing is much greater, which shall generate harm to the facility around and even endanger the life security of the people around. Furthermore, although the effect of sealing by the scroll diaphragm is good, the diaphragm is liable to be broken by the pressure and the repeated turnover, such that the use life of the flushing mechanism will be influenced directly. Additionally, it is not easy for the hydraulic actuating system to be maintained because of the complicated structure.

WO 02/46540 (hereafter referred to the reference 2, the entire disclosure of which is incorporated herein by reference) discloses a device for discharging liquid volume, which comprises a housing with inlet and outlet, a spring loading piston, an inlet valve and an outlet valve. The outlet valve is in a form of spring loading double-head sealing piston, and the spring loading double-head sealing piston comprises a sealing surface disposed at one end for closing the outlet and an actuating surface disposed the other end oppositely. The actuating surface is defined to be actuated by the water with a certain pressure in the actuating room of the housing. The inlet valve is in a form of electromagnetic switches.

The electromagnetic switch is adapted in the device, and thus, a power supply is needed in the place where the device is mounted in a complex structure. Although the reference 2 fails to disclose the material of the housing, if the metal housing is adapted, the cost and weight of the device shall be increased, and if the plastic housing is adapted, the housing shall possess the same problems of breaking of the housing caused by the aging or the accidental crushing and dropping during the use and mounting, which shall generate harm to the facility around and even endanger the life of the people around.

The above applications are taken as the reference documents for the present application, the entire disclosures thereof shall be incorporated in the present application.

In the other aspect, as standard of living is improved, the people pays more and more attention to the personalized decoration of the bedroom or hotel, such that it is one of direction for the researchers to make great effects to endow the designation of the bathroom apparatus with a greater flexibility.

SUMMARY OF THE INVENTION

Based on the above shortcomings in the prior art mentioned above, this invention provides a flushing mechanism for flushing ordure and/or sewage, in particular, a flushing mechanism adapted to flush a toilet bowl. Said flushing mechanism not only achieve less water consumption for each flushing cycle by utilizing the elasticity and force of a loading spring and water pressure to lower the water pressure, but also makes sure the security and convenience for mounting it in various toilet bowls.

According to the invention, the flushing mechanism comprises: a housing including an open upper portion, a lower portion having an opening at the center, and having an inner side that defines a chamber for storing water and receiving other members, and a plurality of conduits disposed at the lower portion of the housing for forming a plurality of water flow passages with the chamber defined by the housing respectively; an upper cover having a top portion and a lower portion for engaging the housing; a sleeve having a center line coincident with a center line of the housing going through the chamber; a first piston, comprising a first piston bottom having a central hole and a first piston cylindrical portion extending upwardly from the periphery of the central hole of the first piston bottom, wherein a side face of the first piston bottom is disposed with a groove in the radial direction, the first piston cylindrical portion is hollow, and the sleeve goes through the first piston cylindrical portion and the central hole in the first piston bottom; a first piston sealed module, disposed in the groove of the side face of the first piston bottom, that causes the first piston to reciprocate upward and downward hermetically along the inner wall of the housing; a first piston loading spring, with one end thereof being fixed inside of the top portion of the upper cover and the other end being fixed to the upper surface of the first piston bottom, which applies force to the first piston; a second piston, comprising a second piston bottom having a central hole and a second piston cylindrical portion extending upwardly from the periphery of the central hole of the second piston bottom, wherein the second piston cylindrical portion is hollow, and the sleeve goes through the second piston cylindrical portion and the central hole in the second piston bottom; a second piston loading spring, disposed around the sleeve inside the hollow portion of the second piston cylindrical portion with one end thereof being fixed inside of an upper end of the second piston cylindrical portion and the other end being fixed at a fixed end of the sleeve; at least one of a pressure-relief or an ejection-proof part provided in the housing; and a second piston sealed module, which surrounds the periphery of the second piston bottom and the periphery of the central hole of the second piston bottom. The second piston bottom, the second piston sealed module and the lower portion of the housing together define an exterior lower cavity and an interior lower cavity for cooperating with the second piston loading spring during the course of the drainage so as to cause the second piston to move upward and an outlet thus to be opened.

Preferably, the pressure-relief or ejection-proof part is a spring limit unit. The unit comprises a top lid, at least one screw rod, the first piston loading spring and an outlet flange, wherein the screw rod goes longitudinally through the chamber of the housing coincidentally or in parallel with the center line of the housing, and one end of the screw rod is fixed inside the top lid, and the other end is fixed to the outlet flange.

Optionally, the spring limit unit may comprise one screw rod disposed inside of the sleeve coincident with the center line of the housing. Of course, it may include a plurality of screw rods disposed in parallel around the first and second piston loading springs by the similar way.

Preferably, the pressure-relief or ejection-proof part is at least one pressure-relief opening disposed at the place slightly higher than an upper stopping point of the first piston along the periphery of the upper portion of the housing.

The pressure-relief or ejection-proof part can also be an ejection proof-pressure relief safety valve.

Of course, the pressure-relief or ejection-proof part can be any combination of one or more from among the spring limit unit, the at least one pressure-relief opening, and the ejection proof-pressure relief safety valve.

Preferably, the flushing mechanism further comprises a guiding rod for mounting the flushing mechanism, and the guiding rod functions to guide the first piston and servers as an ejection-proof member.

The sealed assemblies of the first piston and the second piston comprise an exterior sealed member and an interior sealed member, wherein the interior sealed member includes an elastic member formed by bending a metal sheet, and the exterior sealed member includes an O-shaped ring. Obviously, the structure of the first piston sealed module can be the same as that of the second piston sealed module, or different.

Preferably, the present flushing mechanism further includes a water level switch. The switch pushed by the first piston controls the connection and closing between a water supplying passage and a water compensating passage by moving a certain distance.

Preferably, the present flushing mechanism further includes a pressure stabilizing unit.

The housing according to the present invention can be in the shape of cylinder, oval or other shapes.

The flushing mechanism in the present invention can save the water consumption for each flushing cycle as well as achieve a good flushing result by utilizing the elasticity of the loading spring and the head pressure of water supply. The test has proved that the flushing mechanism according to the present invention can reduces the water consumption to 4 L for each cycle under the circumstance of satisfying the required flushing effect.

Since the present invention is provided with the pressure-relief and/or ejection-proof part such as the spring limit unit or the pressure-relief opening, the first piston keeps moving upwardly to the pressure-relief opening and then the water can flow out from the pressure-relief opening so as to protect the housing from breakage caused by the pressure of water supply when the water level switch functions improperly; and when detaching the flushing mechanism, the long screw rod looses off until the energy of the spring is completely released, therefore accidents can be avoided.

Moreover, since the present invention simply utilizes the second piston sealed module to form the exterior lower cavity and the interior lower cavity hermetically with the end surface of the lower end portion of the housing, and moves the second piston upwardly by virtue of the elasticity of the second piston loading spring, it has a simple, compact structure with a convenient mounting and installation and can be adapted to various toilet bowls. The present invention has great flexibility in mounting inside or outside of the toilet bowl even inside the wall and thus provides the designation of the bathroom apparatus with a considerable degree of flexibility and satisfies various requirements for decoration.

BRIEF DESCRIPTION OF THE DRAWINGS

The followings are the detailed depictions to the present invention by taking the toilet bowl as an example combined with the embodiments shown in figures. The same members in the entire figures are indicated by the same reference signs.

FIGS. 8A-8C illustrate two embodiments about the pressure-relief and/or ejection-proof part according to the present invention, wherein FIG. 8A is an illustration figure for the structure of the spring limit unit; FIG. 8B is an illustration figure for showing the screw rod causing the spring being able to release its energy gradually when detaching; FIG. 8C illustrates the position of the pressure-relief opening.

DETAILED DESCRIPTION OF THE INVENTION

From the following detailed description taken in conjunction with the drawings and subject claims, other objects and advantages of the present invention will become apparent to those skilled in the art.

Figure 1:
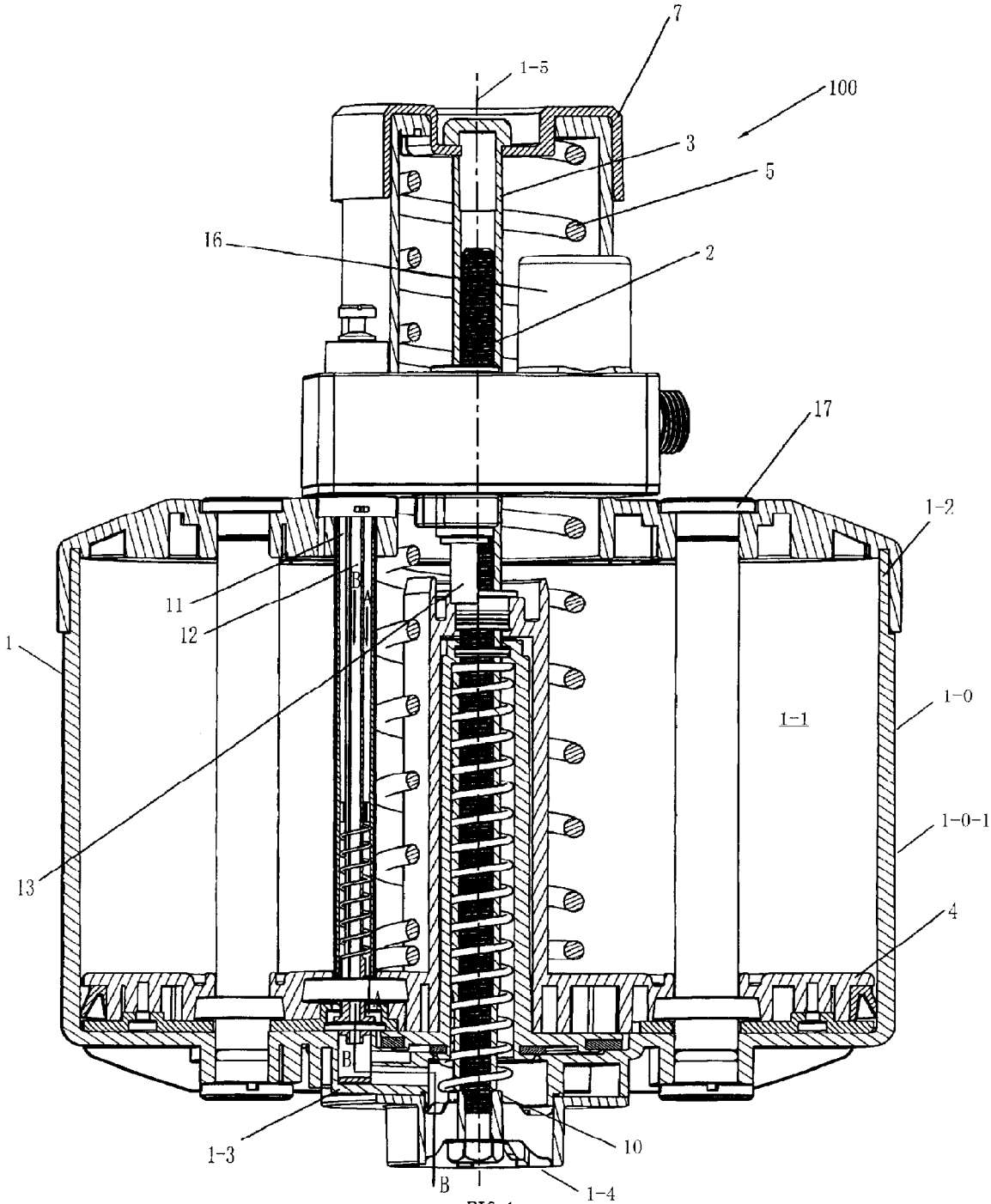
FIG. 1 is a perspective view of configuration of the internal members of the flushing mechanism according to the present invention.
Figure 2:
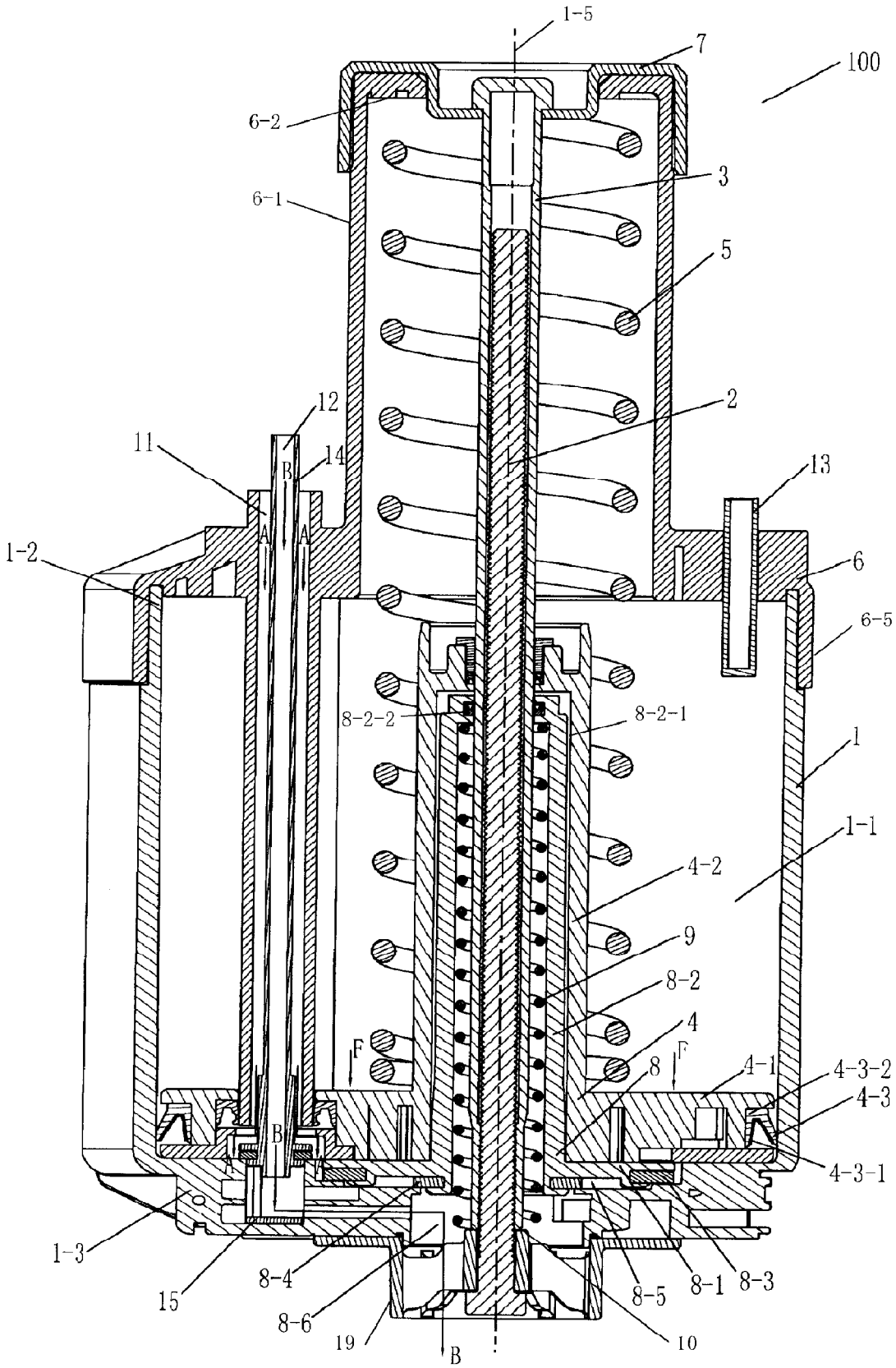
FIG. 2 illustrates the circumstance when the second piston is in an initial position.

FIGS. 1 and 2 show the configuration of the internal members of a flushing mechanism 100 according to the present invention; FIG. 2 illustrates the circumstance when a second piston is in an initial position. Referring to FIG. 1 and FIG. 2, the flushing mechanism of the invention comprises: a cylindrical housing 1 including a housing wall 1-0 having a cylindrical inner surface 1-0-1, with an opened upper portion 1-2 and an opening 1-4 at the center of the lower end portion or bottom 1-3 of the housing 1 for defining a chamber 1-1 used for storing water and receiving the internal members of the flushing mechanism 100 flowing toward the interior of the cylinder housing 1, wherein the lower end portion of the housing 1 is provided with a plurality of conduits for forming the water flow passage with the chamber 1-1 respectively; a screw rod 2, disposed longitudinally in the housing 1 and concentrically with the center line or axis 1-5 of the housing 1; a sleeve 3, disposed concentrically around the screw rod 2 along the center line; a first piston 4, comprising a first piston bottom 4-1 with a central hole 4-4 (shown in FIG. 6) and a first piston cylindrical portion 4-2 extending upwardly from the periphery of the central hole of the first piston bottom 4-1, wherein the outer diameter of the first piston bottom 4-1 is slightly smaller than the inner diameter of the housing 1, and the first piston 4 reciprocates upward and downward hermetically with the housing 1 in virtue of a first piston sealed module 4-3. Moreover, the first piston 4 is mounted concentrically around the sleeve 3, and the cylindrical portion 4-2 of the first piston 4 is hollow, wherein the screw rod 2 and the sleeve 3 go through the first piston cylindrical portion 4-2 and the central hole of the first piston bottom 4-1; the first piston loading spring 5, which is disposed around the cylindrical portion 4-2 of the first piston 4 with one end thereof being fixed at the inside of the top portion 6-1 of the upper cover 6 of the housing and the other end being fixed to the upper surface of the bottom 4-1 of the first piston 4, performs a function to apply the force (F) to the first piston 4; an upper cover 6 of the housing, which is formed to adapt to enclose the first piston loading spring 5 and fix the first piston loading spring 5 inside an upper chamber 1-1-2 (shown in FIG. 3) within the upper end surface 6-2, wherein the exterior of the top portion 6-1 of the upper cover 6 of the housing is provided with a top lid 7 so as to seal the upper end of the top portion 6-1 of the upper cover 6 of the housing. The lower portion 6-5 of the upper cover 6 of the housing is engaged with the housing 1 and is taken as a part of the housing 1. Other through-holes are provided on the upper cover 6 of the housing such that the member such as a water level switch 13 can go through.

Moreover, the present flushing mechanism further comprises a second piston 8 comprising a second piston bottom 8-1 with a central hole 8-1-1 and a second piston cylindrical portion 8-2 extending upward from the periphery of the central hole of the second piston bottom 8-1, wherein the second piston cylindrical portion 8-2 is hollow, and the screw rod 2 and the sleeve 3 go through an opening in the upper end 8-2-1 of the second piston cylindrical portion 8-2, the upper end 8-2-1 having a seal 8-2-2 slidable along the sleeve 3, and through the central hole of the second piston bottom 8-1. A second piston primary sealed module 8-3 is disposed at the outer periphery of the second piston bottom 8-1, and a second piston secondary sealed module 8-4 is disposed at the periphery of the central hole of the second piston bottom 8-1. The second piston bottom 8-1, the second piston sealed modules 8-3 and 8-4, and the lower end portion 1-3 of housing 1 together define an exterior lower cavity 8-5 and an interior lower cavity 8-6.

Similar to the first piston 4, the second piston 8 is provided with a second piston loading spring 9, the loading spring 9 can be disposed around the sleeve 3 inside the hollow portion of the second piston cylindrical portion 8-2, wherein one end of the second piston loading spring 9 is fixed to the interior of the upper end 8-2-1 of the second piston cylindrical portion 8-2 of the second piston 8, and the other end is fixed to a fixed end 10 of the sleeve 3.

Moreover, the present flushing mechanism further comprises a guiding rod 17 for guiding the piston 4 reciprocating upwardly and downwardly and serving as an ejection-proof member. In order to achieve a compact and simple structure, the guiding rod 17 may in the shape of pipe. Further, the present flushing mechanism is provided with a water supplying passage 11 and a water compensating passage 12 disposed concentrically so as to reduce the occupied space. And in order to make a compact structure, it is preferable to dispose concentrically a commuting valve rod 14 of a commuting valve 15 with the water supplying passage 11 and the water compensating passage 12.

In addition, preferably, the present flushing mechanism 100 comprises a water level switch 13. As mentioned above, the commuting valve rod 14, the passages 11 and 12 and the water level switch 13 may go through the upper cover 6 of the housing and then reach the interior of the housing 1.

The lower portion of the housing 1 is provided with an outlet flange 19 (see FIGS. 2 and 8C) for draining through a drain line to a toilet, shown as reference item 25 of U.S. Pat. No. 4,984,311, which has been incorporated herein by reference.

Preferably, the first piston sealed module 4-3 and the second piston sealed modules 8-3 and 8-4 include an exterior sealed member and an interior sealed member, respectively.

Preferably, the exterior sealed member is an elastic sealed member formed by bending a metal sheet 4-3-1, and the bending shape is adapted to enclasp the interior sealed member 4-3-2. And preferably, the interior sealed member includes an O-shaped ring.

The present flushing mechanism further comprises a pressure stabilizing unit 16 which can stabilize the water pressure.

The operation of the flushing mechanism 100 will be explained hereinafter with reference to the figures.

A. The Initial Step

FIG. 2 illustrates the state when the first piston 4 and the second piston 8 are in the initial position. As shown in FIG. 2, in the initial position, the water in the chamber 1-1 has been drained empty, at the same time, the bottom 4-1 of the first piston 4 is in the lowest position (the lower stopping point) under the force of the first piston loading spring 5. The second piston 8 is also in the lowest position under the downward pressure of the first piston 4, and the exterior lower cavity 8-5 of the second piston 8 is sealed, and its inner pressure is equal to the atmospheric pressure, and the inner pressure of the interior lower cavity 8-6 is equal to the atmospheric pressure, the outlet is closed, meanwhile, the water supplying passage 11 and the water compensating passage 12 and the associated portions are in a closed state. In the initial step, the chamber 1-1 is in communication with the atmosphere, and the upper surface of the first piston bottom end 4-1 is pressed by the atmospheric pressure, at this time, the total force applied onto the upper surface of the first piston bottom 4-1 is F.

B. The Step of Water Supplying and Water Compensating

Figure 3:
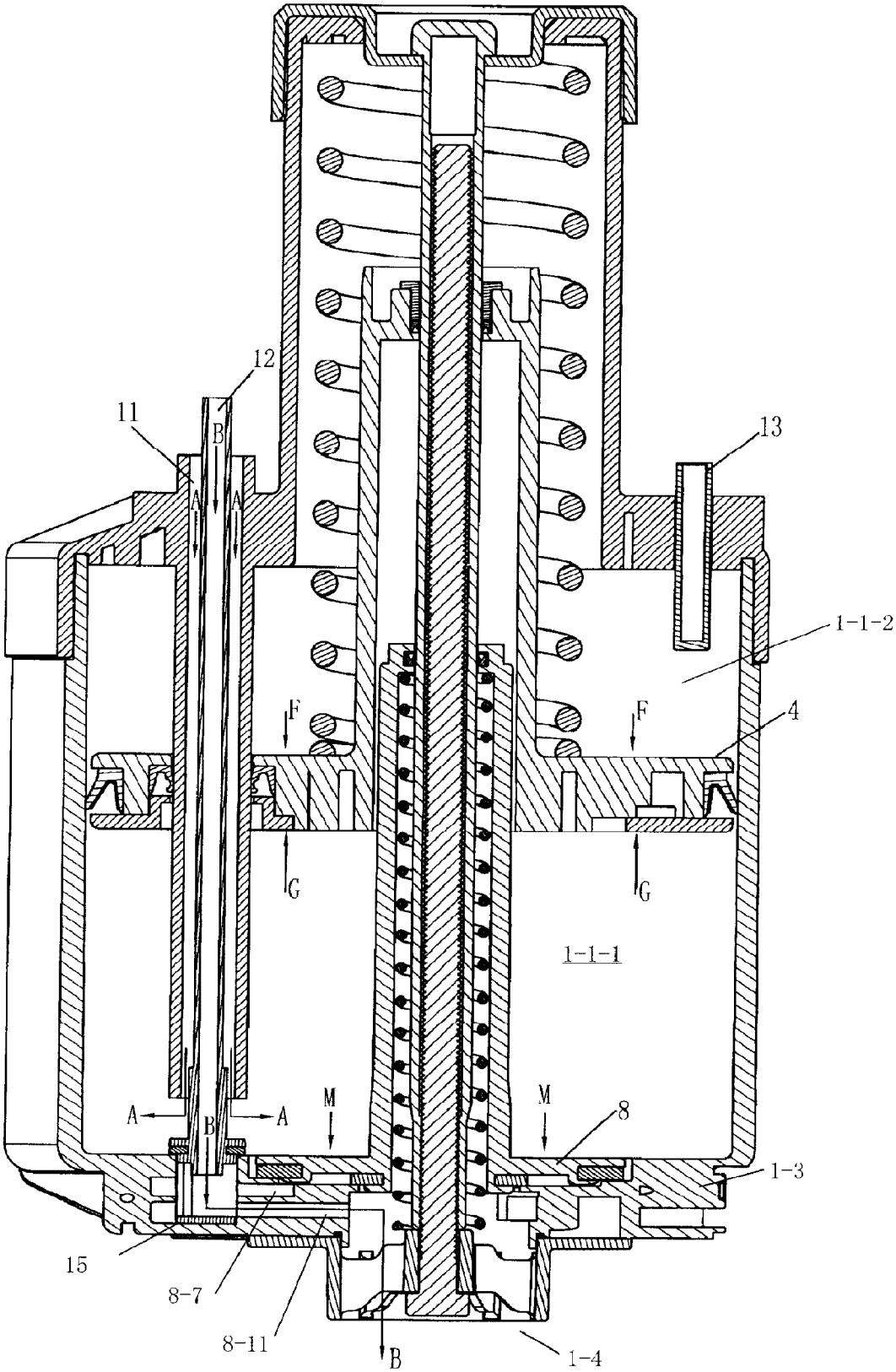
FIG. 3 illustrates the state of the first piston and the second piston during the steps of water-supplying and water-compensating.

FIG. 3 illustrates the state of the first piston 4 and the second piston 8 in the step of water supplying and water compensating. Referring to the FIG. 3, controlled by the water level switch 13, water supplying passage 11 and the water compensating passage 12 are connected to a water supply source (not shown), and a flow of water flows from the water supplying passage 11 into a lower chamber 1-1-1 the housing 1, as shown by arrow A, another flow of water flow from the water compensating passage 12 into a water storing gulf of a toilet bowl (not shown), shown as arrow B. At this time, the first piston 4 is subjected to the force G from the water pressure in the water pipe greater than the total force F combined with the pressure of the first piston loading spring 5 and the atmospheric pressure in the upper chamber 1-1-2 of the chamber 1-1, the first piston 4 thus is moved upward, and the force M from the water pressure within the lower chamber 1-1-1 applying on the second piston bottom 8-1 of the second piston 8 is greater than the upward force H of the second piston loading spring 9, the second piston 8 thus is kept at the lowest position.

C. The Step of Keeping Water Supplying but Stopping Water Compensating

Figure 4:
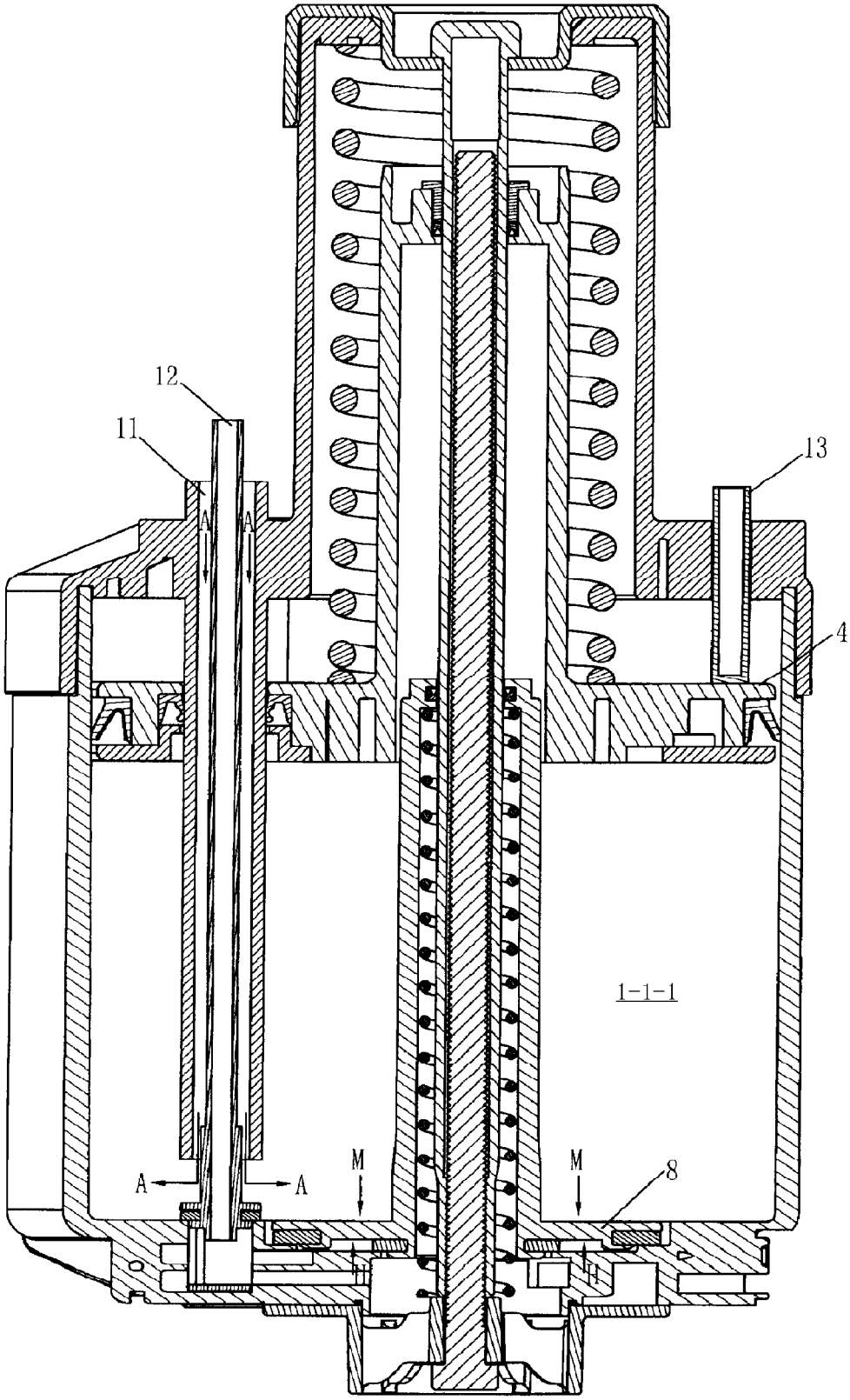
FIG. 4 illustrates the state of the water-supplying passage, the water-compensating passage, the first piston and the second piston during the course of keeping supplying the water and stopping compensating the water.

FIG. 4 illustrates the state of the first piston 4 and the second piston 8 at the step of keeping water supplying but stopping the water compensating. Referring to FIG. 4, the first piston 4 moves upward to push the switch 13 to move a certain distance, such that the water level switch 13 closes the connection passage between the water compensating passage 12 and the water supply source (not shown), so as to stop supplying the water to the water compensating passage 12, at this time, the water supplying passage 11 is still connected with the water supply source (not shown), and the water is supplied continuously, shown as arrows A. The second piston 8 overcomes the upward force H of the second piston loading spring 9 in virtue of the force M and thus is kept at the lowest position.

D. The Step of Stopping the Water Supplying

Figure 5:
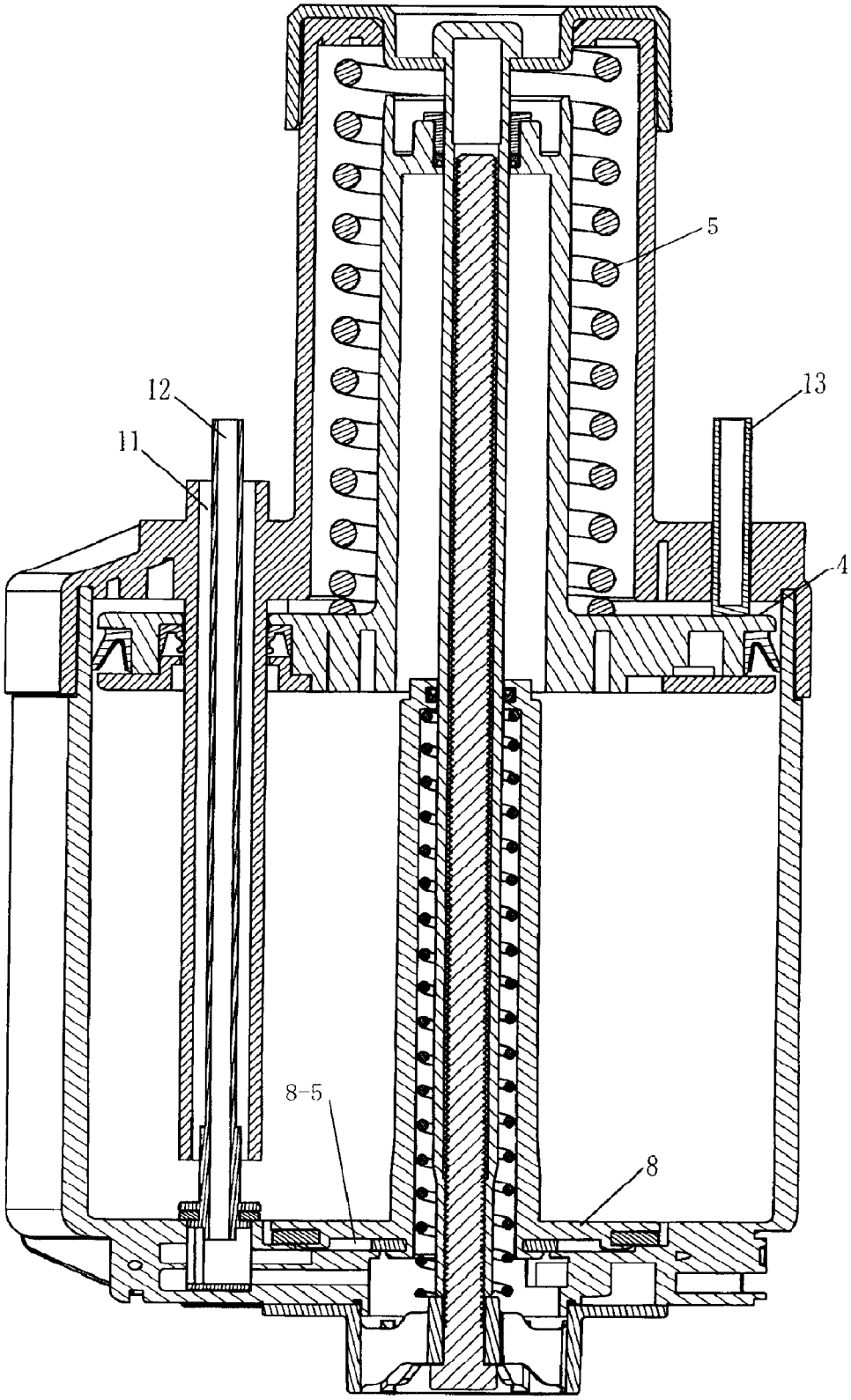
FIG. 5 illustrates the state of the first piston, the second piston and the connection status for each passage in the course of stopping supplying the water.

FIG. 5 illustrates the state of the first piston 4 and the second piston 8 in the flushing mechanism 100 in the step of finishing the water supplying. Referring to FIG. 5, the first piston 4 continues moving upwardly to push the water level switch 13 moving a certain distance such that the water level switch 13 closes the connection passage of the water supplying passage 11 and the water supply source (not shown) and stops supplying the water to the water supplying passage 11, meanwhile, the water compensating passage 12 is still not connected to the passage of the water supply source (not shown), and the housing 1 is filled with the predetermined amount of water when the water supplying is finished. At this time, the first piston loading spring 5 is compressed for storing energy. Under the pressure of the water in the housing 1, an upward force is generated, which is equal to the downward elasticity of the first piston loading spring 5, and the first piston 4 is kept at the position of upper stopping point, and the second piston 8 is still kept at the lowest position under the force M.

E. The Step of Draining

Figure 6:
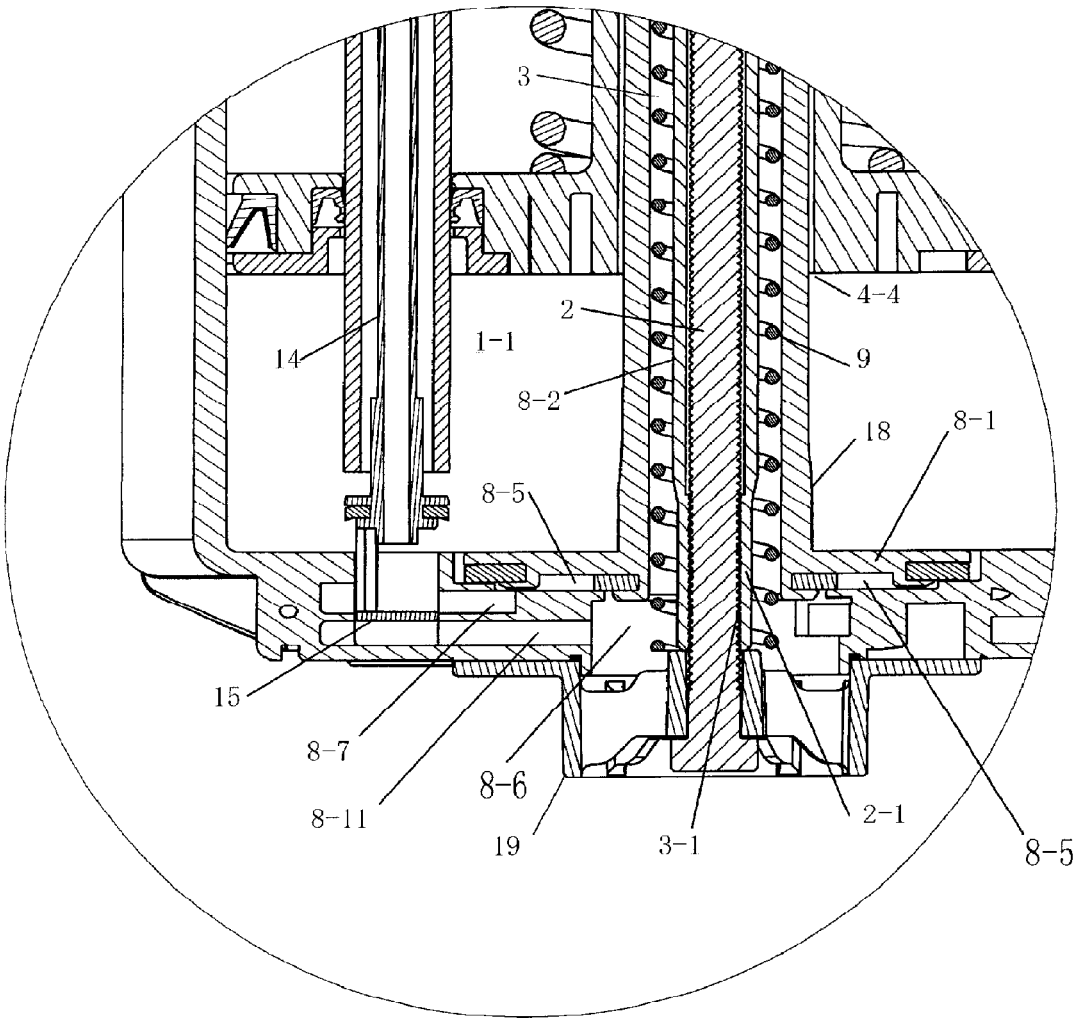
FIG. 6 partially illustrates the state of the first piston, the second piston and the connection circumstance for each passage in the course of preparing releasing the water by lifting and diverting the valve rod.
Figure 7:
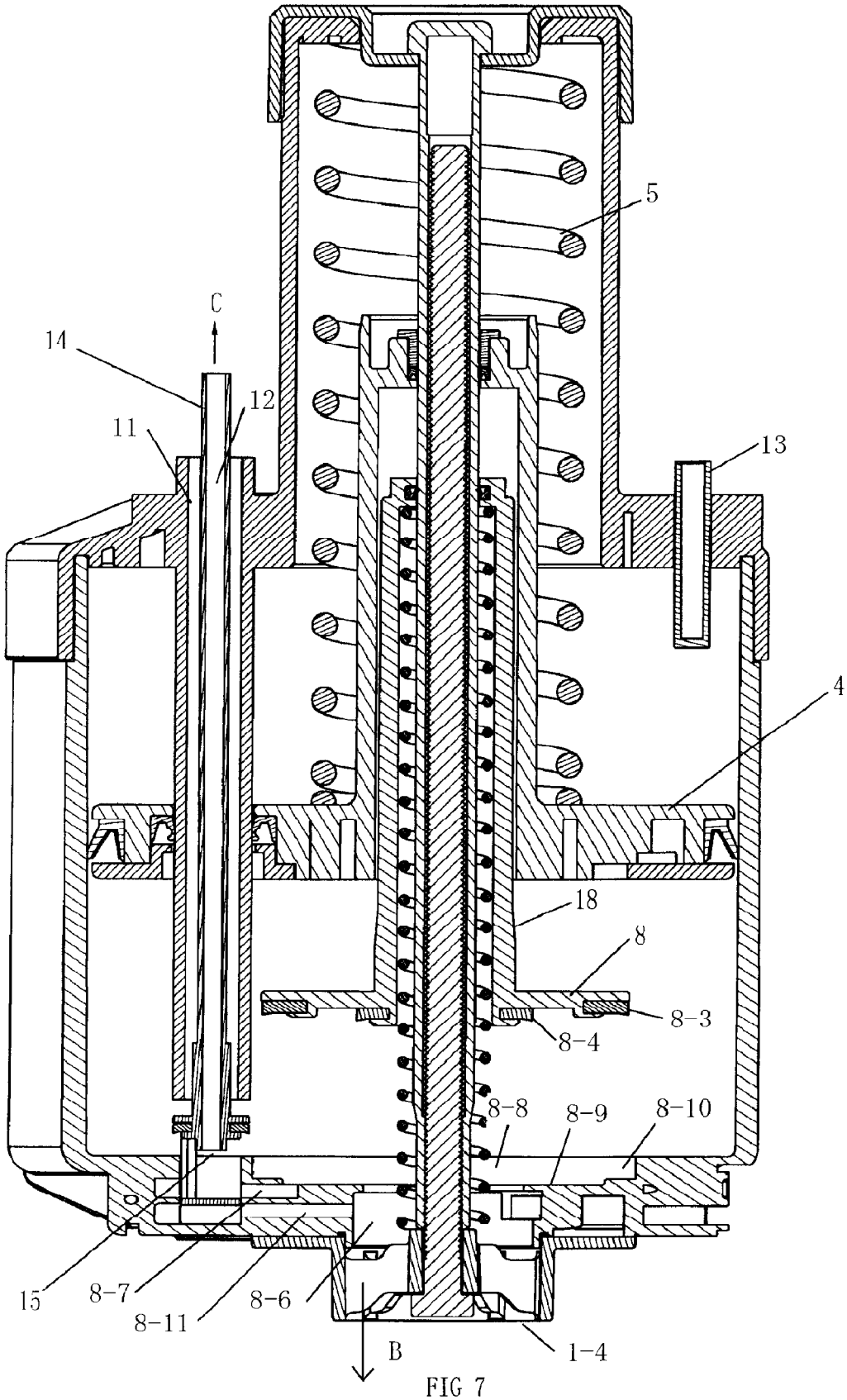
FIG. 7 illustrates the state of the first piston, the second piston and the connection circumstance for each passage at the interior of the housing in the course of releasing the water.

FIG. 6 partially illustrates the connection state of the first piston 4, the second piston 8 and the passages in the housing 1 when lifting the commuting valve rod 14 to prepare for draining. FIG. 7 illustrates the connection state of the first piston 4, the second piston 8 and the passages in the housing 1 at the step of draining.

As shown in FIGS. 6 and 7, when the toilet bowl is needed to be flushed, pressing a button (not shown), by lifting the commuting valve rod 14 upwardly along the direction shown as arrow C through a link commuting device (not shown), the commuting valve 15 is actuated, such that the passages 8-7 are opened, and the exterior lower cavity 8-5 of the second piston 8 and the chamber 1-1 in the housing 1 are connected with each other, the water then flow from the chamber 1-1 into the exterior lower cavity 8-5 of the second piston 8, wherein the downward water pressure and the upward water pressure are counteracted to each other at the corresponding area of the second piston 8 between the second piston sealed module 8-3 at the outer periphery of the second piston bottom 8-1 and the second piston sealed module 8-4 at the periphery of the central hole of the second piston bottom 8-1, and the downward water pressure still applies to the area of the second piston 8 corresponding to the second piston sealed module 8-4 at the periphery of the central hole of the second piston bottom 8-1. When the downward water pressure applied on the area of the second piston 8 corresponding to the second piston sealed module 8-4 at the periphery of the central hole of the second piston bottom 8-1 is smaller than the upward force of the second piston loading spring 9, the second piston 8 moves upward, the outlet 1-4 is thus opened, and the water is drained from the outlet.

After the step of draining continues for a while and the second piston 8 moves upward at a certain distance, the downward water pressure of the second piston 8 counteracts to the upward water pressure of the corresponding portion, and the second piston 8 speeds up to move upwardly by the force of the second piston loading spring 9. In order to avoid noise generated by the collision between the second piston 8 and the first piston 4 because of the over fast relative moving speed and avoid the damages of the first and second pistons, the second piston cylindrical portion 8-2 of the second piston 8 is upwardly formed in a shape with a reduced outer diameter at a certain distance from the upper surface of the second piston bottom 8-1 and is formed with a slope step portion 18 in this transition section with the reduced outer diameter, such that the speed of the second piston 8 is reduced when moving upward approaching to the first piston 4 so as to make the slope step portion 18 serving as a buffer against the collision.

When the draining step is finished, the water level switch 13 is reset, and the water supplying passage 11 and the water compensating passage 12 are closed, the first piston 4 moves downward to the lower stopping point under the downward push-force of the first piston loading spring 5. The second piston 8 returns to the lowest position under the force M, one cycle of water supplying-water draining is completed.

As depicted in the above, in order to solve the safety problem of breaking of the housing that would damage the facility around caused by the aging of the plastic housing or accidental collision and dropping made by the carelessness of people during the mounting and operation, the present invention adopts a series of safety measures.

Figure 8C:
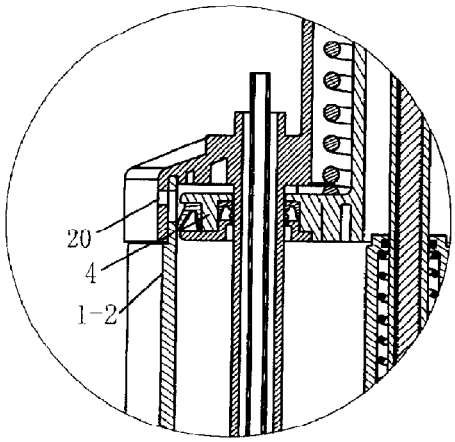
Figure 8A:
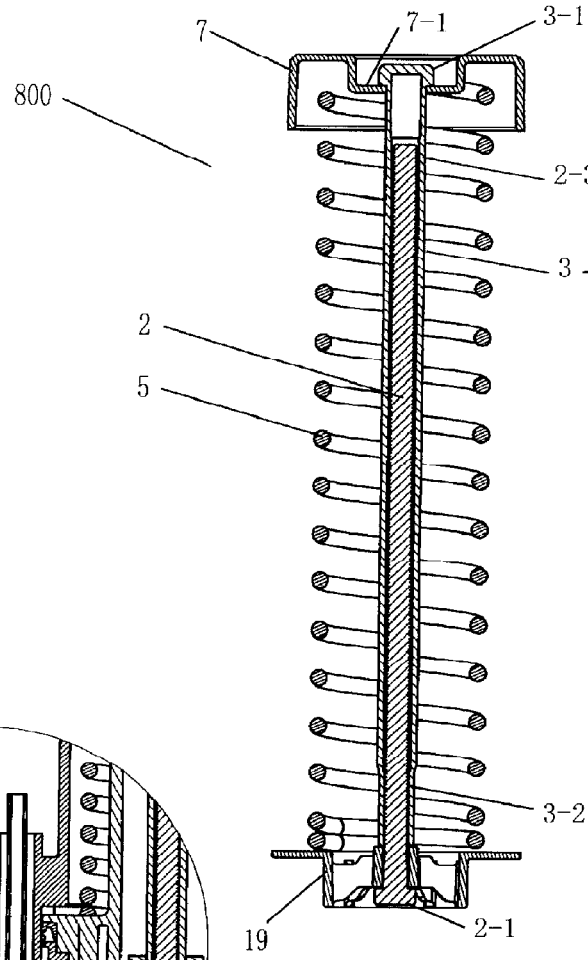
Figure 8B:
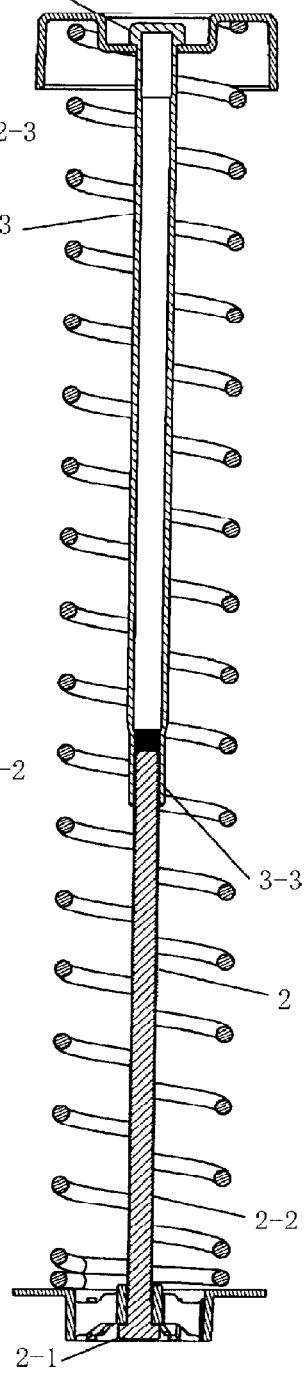

FIGS. 8A-8C are the illustration figures for two embodiments of a pressure-relief and/or ejection-proof part, wherein FIG. 8A shows the structure of a spring limit unit; FIG. 8B is a figure illustrating that a bolt gradually releases the energy of a spring when detaching; FIG. 8C illustrates a disposing position of a pressure-relief opening.

As shown in FIG. 8A, the pressure-relief and/or ejection-proof part according the invention can be various types, for example, it can be a spring limit unit 800. The spring limit unit 800 comprises a top lid 7, at least one screw rod 2 having a head 2-1 at one end and having threads 2-2 at the second end 2-3 and along the length of the screw rod, a sleeve 3 having an upper end 3-1 and a threaded lower end 3-2, a first piston loading spring 5 and an outlet flange 19. The rod 2 longitudinally goes through the chamber 1-1 of the housing 1 in parallel or coincidentally with the center line of the housing and is provided in the sleeve 3. One end of the screw rod 2 is fixed to the interior side 7-1 of the top lid 7 for retaining the first end of the spring 5, and the threaded lower end of the sleeve 3 is fixed to the outlet flange 19 for retaining the second end of the spring 5 in a compressed state. As shown in FIG. 8B, when detaching the flushing mechanism 100, since the screw rod 2 is detached until the energy of spring 5 is released completely, accidents can be avoided.

The spring limit unit 800 further comprises a plurality of screw rods disposed in parallel with the center line of the housing 1 in the longitudinal direction around the first piston loading spring 5 and the second piston loading spring 9.

As depicted in FIG. 8C, the pressure-relief and/or ejection-proof part can further be at least one pressure-relief opening 20 disposed at the place that is slightly higher than the upper stopping point of the first piston 4 along the periphery of the upper portion 1-2 of the housing 1. If the water level switch 13 is in trouble, the first piston 4 keeps moving upwardly to the pressure-relief opening 20, then the water can flow out from the pressure-relief opening 20 so as to prevent the housing from breaking caused by the pressure of the water supplying.

Of course, the pressure-relief and/or ejection-proof part can further be an ejection-proof and/or pressure-relief safety valve, or can be any combination among the spring limit unit and/or the at least one pressure-relief opening and/or the ejection proof-pressure relief safety valve.

It is worth mentioning that the above examples are merely for explanation, which shall not be understood as the limit to the present invention. In the precondition of not going beyond the scope and concept of the present invention, those skilled in the art can make multiple modifications to the present invention. For example, the housing 1 can be cylinder, olive or other shapes; the commuting valve rod 14 and the commuting valve 15 can be operated manually, and the commuting operation can be automatically performed by the common-known assembly such as optical control units and acoustic control units. Moreover, the water supplying passage 11, the water compensating passage 12 and the commuting valve rod 14 can be disposed separately to each other instead of a coaxial telescopiform configuration. Such modifications shall be included in the protection scope claimed by the present invention.

Since the flushing mechanism in the present invention possesses a simple and compact structure, it can either be mounted at the exterior of the toilet bowl, or be mounted inside of the rear side or lower portion of the toilet bowl, or even be mounted at the wall corresponding to the toilet bowl, such that the invention provides wide flexibility for the design of toilet bowl. That is to say, the flushing mechanism of the present invention is adapted to any configurations of the toilet bowl, which definitely can satisfy various needs for decorating the places like washroom.

Since the present invention utilizes the elasticity of the loading spring and the pressure of the water supplying, the flushing efficiency is improved increasingly, which either can realize the water supplying by low pressure or can save the water consumption for each flushing cycle. Tests prove that the flushing of the present invention can reduce the water consumption for each flushing cycle to 4 L each time under the precondition of satisfying the flushing effect.

As depicted in the above, the present invention can be adapted to other places for flushing feculence and/or sewage besides to the bathroom for flushing the bathroom apparatus such as a toilet bowl.

What is claimed is:

1. A flushing mechanism, comprising:

a housing, including a housing wall and a housing bottom integrally formed with or connected to the housing wall, wherein the housing wall defines a cylindrical inner surface around an axial center line, and has an outlet formed at the housing bottom around said axis that connects to a drain line;

a sleeve, axially fixed along and surrounding the axis within the housing;

a first piston that hermetically slides on the cylindrical inner surface and the sleeve simultaneously along the axial direction, wherein the first piston divides an inner chamber surrounded by said cylindrical inner surface into a lower chamber contacting said housing bottom and an opposing upper chamber;

a first piston loading spring, mounted in said upper chamber around said sleeve for applying spring force from the housing to the first piston so as to move the first piston downwards to reduce the volume of the lower chamber and to expand the volume of the upper chamber;

a second piston that hermetically slides on the sleeve along the axial direction, wherein the second piston is disposed between the first piston and the housing bottom;

a second piston loading spring, mounted around said sleeve for applying spring force from the housing to the second piston so as to move the second piston upward;

a commuting valve;

wherein said flushing mechanism has the following three operation states:

(i) in a first state, the first piston pushes the second piston downwards against the housing bottom to form a ring-shaped exterior lower cavity around said axis and between said housing bottom and the second piston, and the exterior lower cavity is not connected with the chamber and is connected to said outlet;

(ii) in a second state, said lower chamber is filled with supply water to separate the first piston from the second piston and expand the lower chamber, and the second piston overcomes the upward force of the second piston loading spring under the action of the water pressure to go against said housing bottom, and the exterior lower cavity is not connected with said outlet and said lower chamber;

(iii) in a third state, the lower chamber is connected to the exterior lower cavity through a first side passage and the commuting valve, and the upward force of the second piston loading spring moves the second piston away from the housing bottom, such that the lower chamber, the exterior lower cavity and the outlet are connected with each other, and the water in the lower chamber drains through the outlet under the action of the pressure of the first piston; and the commuting valve closes the first side passage, then or simultaneously, wherein the first piston and the second piston reset to the first state.

2. The flushing mechanisms according to claim 1, wherein the first side passage is internally-disposed within the housing bottom.

3. The flushing mechanism according to claim 1, wherein the housing bottom has a step hole around the outlet and the axis, wherein the step hole has a step surface and a cylinder hole, and said exterior lower cavity is formed on the step surface of said step hole.

4. The flushing mechanism according to claim 3, wherein the exterior lower cavity is defined by the second piston, the step surface of the step hole, and a sealing means for the second piston, respectively, between the outlet and the cylinder hole.

5. The flushing mechanism according to claim 3, wherein the exterior lower cavity is defined by the second piston, the step surface of the step hole, and two sealing modules that are axially separated.

6. The flushing mechanism according to claim 1, wherein a second side passage communicates between the commuting valve, and the outlet and the drain line, and wherein in the first and third states, the commuting valve connects the first side passage with the second side passage, and obstructs its connection to the lower chamber, and in the second state, the commuting valve connects the first side passage with the lower chamber and obstructs its connection to the second side passage.

7. The flushing mechanism according to claim 6, wherein the second side passage is internally-disposed within the housing bottom.

8. The flushing mechanism according to claim 1, wherein the first piston includes a first piston top portion that moves along the sleeve along an axial direction and a first piston bottom portion that moves axially along the cylindrical inner surface of the housing, and a first piston cylindrical portion integrally connecting the top portion and the bottom portion along the axial direction, and wherein the first piston loading spring contacts with said first piston bottom around said first piston cylindrical portion to apply the spring force.

9. The flushing mechanism according to claim 8, wherein the side surface of said first piston bottom has at least one groove, and a first piston sealing module is disposed in the groove.

10. The flushing mechanism according to claim 8, wherein the second piston comprises a second piston bottom, wherein in said first and second operation states, the second piston bottom and said housing bottom define the exterior lower cavity, wherein the second piston further comprises a second piston top portion slidably sealing with the sleeve and a second piston cylindrical portion that integrally connects the bottom portion and the top portion of the second piston, wherein the second piston cylindrical portion inserts into the first piston cylindrical portion, and the second piston loading spring is disposed between said sleeve and the second piston cylindrical portion.

11. The flushing mechanism according to claim 10, wherein the second piston has second piston primary sealing module disposed at the outer periphery of the second piston bottom portion, and a second piston secondary sealing module disposed at the periphery of the central hole of the bottom portion.

12. The flushing mechanism according to claim 10, wherein the connection between said first piston cylindrical portion and the second piston cylindrical portion is clearance fit, such that they may mutually have a free axial relative movement.

13. The flushing mechanism according to claim 10, wherein the second piston cylindrical portion includes a slope step portion proximate the second piston bottom, wherein the connection between the second piston cylinder portion and the first piston cylindrical portion is clearance fit, and the connection between the slope step portion and the first piston cylindrical portion is a friction-sliding fit.

14. The flushing mechanism according to claim 1, wherein the housing has an upper cover mounted at the upper end portion of the housing wall, wherein the sleeve is fixed to the upper cover, and the first piston loading spring directly contacts the upper cover.

* * * * *